US007216741B2

(12) United States Patent
MacDonald et al.

(10) Patent No.: US 7,216,741 B2
(45) Date of Patent: May 15, 2007

(54) SAFETY CAGE FOR GANGWAY

(75) Inventors: Ellie Harold MacDonald, Timmonsville, SC (US); Darrel Scott Cramer, Florence, SC (US)

(73) Assignee: Aluminum Ladder Company, Florence, SC (US)

( * ) Notice: Subject to any disclaimer, the term of this patent is extended or adjusted under 35 U.S.C. 154(b) by 438 days.

(21) Appl. No.: 10/929,217

(22) Filed: Aug. 30, 2004

(65) Prior Publication Data

US 2006/0054392 A1 Mar. 16, 2006

(51) Int. Cl.
*E04G 5/14* (2006.01)
*E04G 3/28* (2006.01)

(52) U.S. Cl. ..... 182/113; 182/141

(58) Field of Classification Search ..... 182/113, 182/106, 112, 115, 127, 141, 143, 145, 148; 256/59; 244/137.1, 137.2
See application file for complete search history.

(56) References Cited

U.S. PATENT DOCUMENTS 2,778,694 A * 1/1957 Mitchell ..... 182/113
2,798,652 A * 7/1957 Easton ..... 182/113
3,693,754 A * 9/1972 Butler ..... 182/113
4,013,140 A * 3/1977 Pradon ..... 182/106
4,572,328 A * 2/1986 Benko ..... 182/113
4,679,657 A 7/1987 Bennett et al. ..... 182/113
4,787,111 A * 11/1988 Pacek et al. ..... 182/113
5,027,922 A * 7/1991 Benko et al. ..... 182/113
5,042,612 A 8/1991 Bennett et al. ..... 182/1
5,299,653 A * 4/1994 Nebel ..... 182/113
5,381,872 A * 1/1995 Peruzzi et al. ..... 182/63.1
5,392,878 A 2/1995 Bennett et al. ..... 182/115
5,967,258 A * 10/1999 Scott et al. ..... 182/113
6,145,619 A * 11/2000 Risser ..... 182/113
6,152,492 A * 11/2000 Markham et al. ..... 182/113
6,390,152 B1 5/2002 Donovan et al. ..... 141/279
7,140,467 B2 * 11/2006 Cook ..... 182/143

* cited by examiner

*Primary Examiner*—Hugh B. Thompson, II
(74) *Attorney, Agent, or Firm*—Charles L. Schwab; Nexsen Pruet, LLC

(57) ABSTRACT

A safety cage improves the safety of workers servicing tanker vehicles having top side hatches. A part or parts of the cage can be repositioned to permit the hatch cover to be opened and then can be returned to a safety enchancing position.

7 Claims, 3 Drawing Sheets

SAFETY CAGE FOR GANGWAY

BACKGROUND OF THE INVENTION

When loading tanks of transport trucks it is necessary for a workman to open the hatch or hatches on the tank prior to loading and to close the hatches after loading. The surface of the tank is cylindrical and may be slippery which presents a hazardous condition for the workman. The hatch cover is normally hinged on a horizontal axis extending in the longitudinal direction of the tank and truck and when opened it is desirable to pivot the hatch cover to a fully open position in which the top of the cover rests on the upper part of one lateral side of the tank. If the side railing of a safety cage is spaced laterally outward a sufficient distance to permit the hatch cover to be fully opened, the side railing would be positioned too far laterally to prevent the worker from falling. It also may be too far away to be used by the worker as a grab bar to regain balance or to stop a fall.

SUMMARY OF THE INVENTION

This safety cage presents a safety railing structure which includes a grab bar section at each lateral side which can be pivoted from its downwardly extending guard position to an upwardly extending position to permit the tank hatch cover to be pivoted to a fully open position at one or the other lateral side of the container. The grab bar section is then pivoted back to its downwardly extending guard position. The safety cage may be attached to an adjustable stairway with self leveling steps which in turn is mounted on an access platform. The adjustable stairway permits lowering of the cage to a safety enhancing position and provides upward adjustment of the position of the cage so as to not interfere with the truck moving into its position for opening or closing the hatch. Once the truck is in its servicing position the safety cage is lowered by downwardly adjustment of the stairway to afford the worker access and protection.

BRIEF DESCRIPTION OF THE DRAWINGS

One embodiment of the invention is illustrated in the drawings in which.

DETAILED DESCRIPTION OF THE INVENTION

Figure 1:
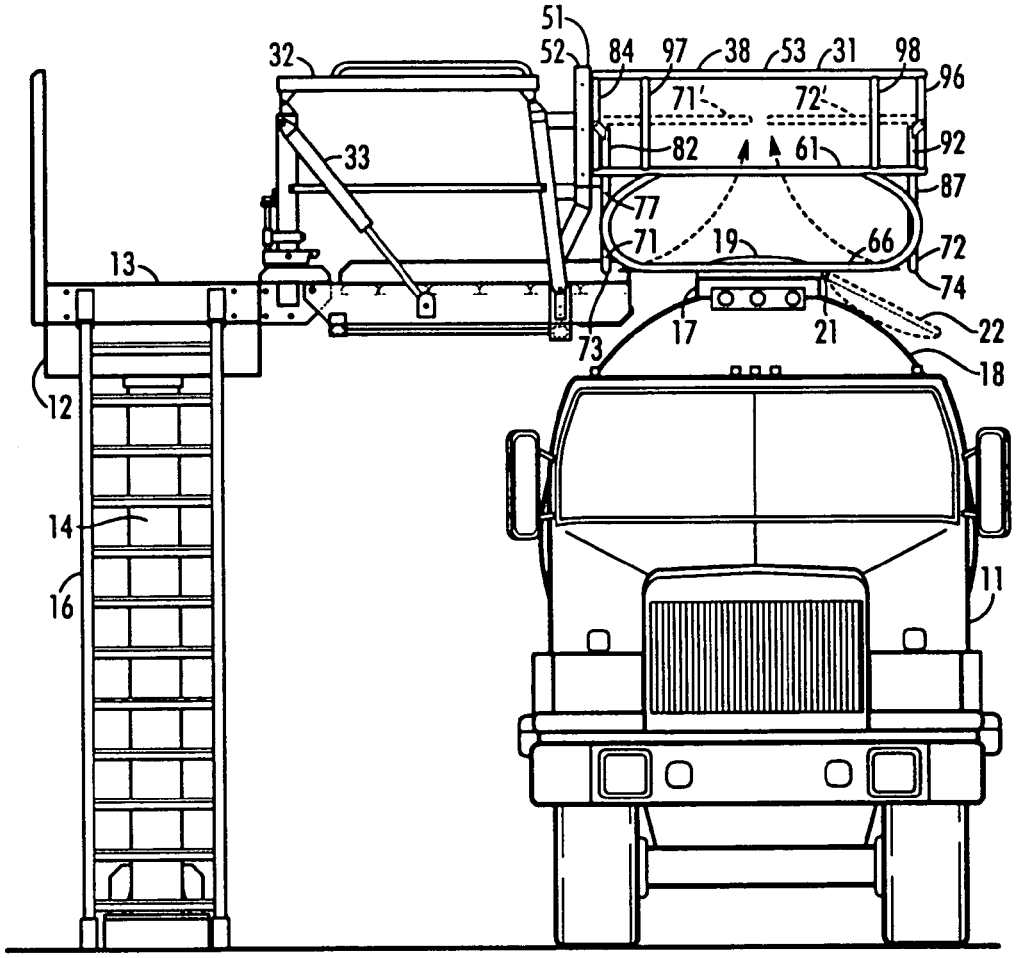
FIG. 1 is a front view of an access platform, the adjustable stairway and the safety cage positioned above the hatch of a bulk material tank mounted on a truck.

FIG. 1 illustrates a tanker vehicle in the form of a bulk material tank truck 11 positioned for servicing at a hatch opening and closing station which includes a worker access or service platform 12 with a floor 13, supported by one or more pillars 14, and a ladder 16. Typical bulk material handling tanker vehicles have a hatch 17 on the top of a tank 18 with a hatch cover 19 which is pivotally hinged to the hatch 17 on a horizontal axis 21 extending in the longitudinal direction of the vehicle, that is, in a fore and aft direction. The open position of the hatch cover is shown by broken lines 22.

In order to enhance the safety of workmen who open and close the hatches of the tanker vehicles, a safety cage 31 is provided, which is designed to be placed in encompassing relation to the hatch 17. The safety cage 31 is supported on the free end of a gangway in the form of an adjustable access stairway 32 having self leveling steps. As shown in FIG. 1, the access stairway 32 has been lowered by extension of a pair of hydraulic actuators 33, to its safety enhancing position in which the bottom of an offset portion 40 of the safety cage 31 is near or adjacent to the hatch 17 on the top of the tank 18 of the tank truck 11.

Figure 2:
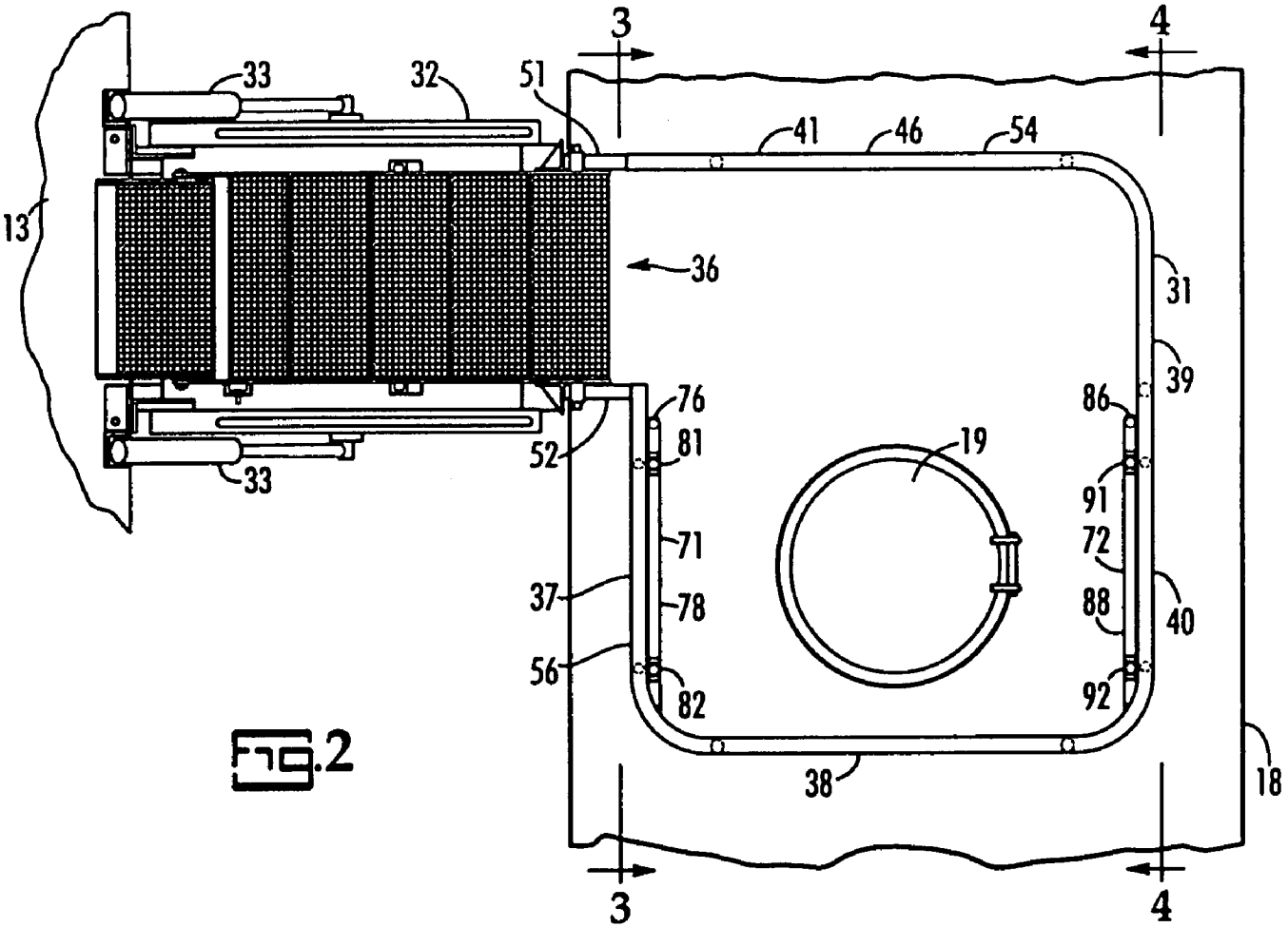
FIG. 2 is a top view of the safety cage and the adjustable stairway shown in FIG. 1.
Figure 3:
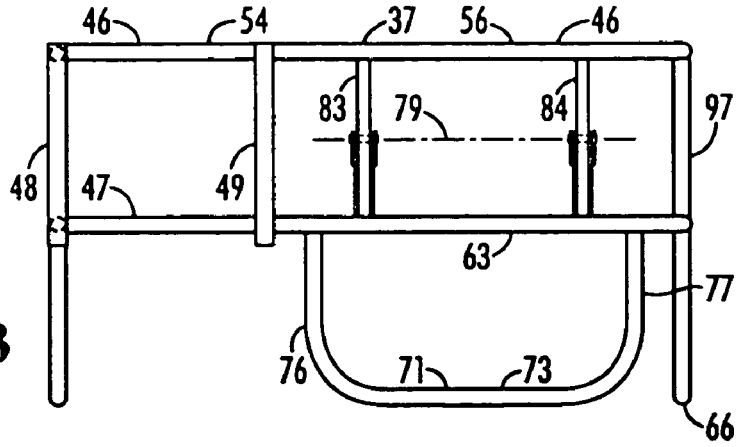
FIG. 3 is a side view of the safety cage taken on line 3—3 in FIG. 2.
Figure 4:
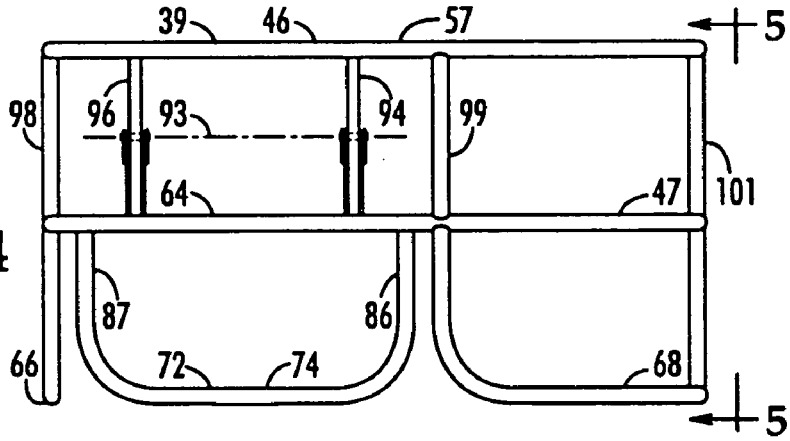
FIG. 4 is a side view of the safety cage taken on line 4—4 in FIG. 2.
Figure 5:
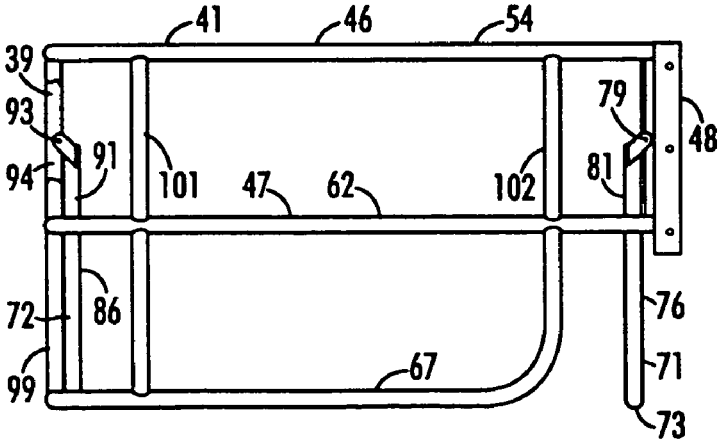
FIG. 5 is a rear view of the safety cage taken in line 5—5 in FIG. 4.

Referring also to FIGS. 2 through 5, the safety cage 31 is a quadrilateral shaped enclosure which includes a worker access opening 36 at one end of a first lateral upright side 37, as shown in FIGS. 1 and 3. The safety cage also includes a front side 38 shown in FIG. 1, a second lateral side 39 shown in FIG. 4 and a rear side 41 shown in FIG. 5. As shown in FIG. 2 the safety cage 31 has an offset portion 40 with the front side 38 and the lateral sides 37, 39 in a safety enhancing position shown in FIGS. 1 and 2. The safety cage 31 includes a horizontal upper tube 46 and a horizontal intermediate tube 47 which are parallel to one another and extend in vertical alignment with one another about the cage with their opposite ends rigidly secured as by welding to vertical mounting brackets 48, 49 by which the safety cage 31 is rigidly secured to upright posts 51, 52 at the end of the stairway 32. The upper tube 46 forms an upper guard rail 53 of the front side 38, an upper guard rail 54 of the rear side 41, an upper guard rail 56 for the first lateral side 37 and an upper guard rail 57 for the second lateral side 39. The intermediate tube 47 forms an intermediate guard rail 61 of the front side 38, an intermediate guard rail 62 of the rear side 41, an intermediate guard rail 63 of the first lateral side 37 and an intermediate guard rail 64 of the second lateral side 39.

The safety cage 31 has a lower guard rail structure which includes a lower guard rail 66 on the front side 38, a lower guard rail 67 on its rear side, and a lower guard rail 68 on part of its second lateral side 39. The lower guard rail structure for the safety cage 31 also includes shiftable grab bar sections 71, 72 which have horizontal guard rails or grab bars 73, 74, respectively, disposed at the same height as the bottom guard rails 66, 67, 68. The grab bar section 71 has vertically extending arms 76, 77 which rigidly interconnect opposite ends of the grab bar 73 with a horizontal support member 78. A pair of parallel upstanding legs 81, 82 are rigidly secured at their lower ends to the support member 78 and extend upward on the laterally inward side of the first lateral side 37 to upper ends pivotally connected on a longitudinally extending horizontal axis 79 to a pair of vertical struts 83, 84, respectively, extending between the upper guard rail 56 and the intermediate guard rail 63. The grab bar section 72 has a pair of vertically extending arms 86, 87 which rigidly interconnect opposite ends of the grab bar 74 with a horizontal support member 88. A pair of parallel upstanding legs 91, 92 are rigidly secured at their lower ends to the support member 88 and extend upward on the laterally inner side of the second lateral side 39 on a longitudinally extending horizontal axis 93 to a pair of vertical spacing struts 94, 96 between the upper guard rail 57 and the intermediate guard rail 64. Addition struts 97, 98, 99, 101, 102 interconnect the top tube 46 to the intermediate tube 47. The intermediate guard rail 63 serves as an abutment which prevents the grab bar section 71 from swinging laterally outward from its downward extending guard position shown in FIG. 2, 3 and 5. In a like manner the intermediate guard rail 64 serves as an abutment for the grab bar section 72, preventing it from swinging laterally outward from its downwardly extending safety position shown in FIGS. 2, 4 and 5.

In performing servicing operations, the gangway or stairway 32 is placed in a raised position by contraction of the hydraulic actuators 32 thereby elevating the safety cage 31. The tank truck 18 is driven beneath the safety cage 31 and the safety cage is lowered to its safety enhancing position shown in FIG. 1. In this position of the safety cage 31 the hatch cover 19 can not be pivoted to its open position shown in broken lines 22 because the grab bar sections 71, 72 are spaced laterally from the hatch cover a distance less than the width of the hatch cover 19. However, upon pivoting the grab bar section 72 to the position shown in broken lines 72' the hatch cover 19 can be opened. The safety cage 31 is then raised and the truck 11 is driven to a loading station, not shown, to receive bulk material such as cement. The loaded tank truck 11 is then driven back to the servicing station where a workman closes the hatch cover 19; at which time the grab bar section 71 is pivoted to its raised position shown by broken line 71' to permit the hatch cover 19 to be closed-assuming the truck 11 is headed in the opposite direction upon its return to the servicing station.

What is claimed is:

1. A work station for servicing a bulk material handling tank truck having a hatch cover pivotable about a horizontal axis extending in the longitudinal direction of the truck from a closed position to an open position in which the top of said hatch cover is disposed at a lateral side of the truck, comprising:

an elevated service platform, a gangway connected at one of its ends to said platform, a safety cage mounted on the other end of said gangway with an access opening at said other end of said gangway for worker entry, said cage having a guard rail structure forming a quadrilateral enclosure except for said access opening and including an offset portion with laterally opposite sides, said laterally opposite sides adapted to be spaced laterally from said hatch cover a distance less than the width of said hatch cover, each of said laterally opposite sides of said offset portion having a lower section which is shiftable between a normal guard position and an adjusted position in which said hatch cover can be pivoted to said open position.

2. The work station of claim 1 wherein each of said lower sections is pivotable about a longitudinally extending axis.

3. The work station of claim 2 wherein each of said lower sections include a longitudinally extending guard rail at its lower end.

4. A safety cage having a safety enhancing position relative to a longitudinally extending vehicle mounted tank with a top hatch cover pivotable about a longitudinal axis to one lateral side of the tank, said safety cage comprising:

an upright front section, an upright rear section, a first upright lateral side section connected at its front end to said front section and having a rear end which terminates short of said rear section to provide an access opening, and a second upright lateral side section having opposite ends connected, respectfully, to said front and rear sections, each of said sections having horizontal top, intermediate and lower guard rails, laterally opposite portions of said lower guard rails of said first and second lateral side walls being formed by first and second grab bars pivotally connected, respectively, on horizontal axes to said first and second side sections for swinging movement laterally inwardly and upwardly from a normal position below their associated intermediate rails to provide clearance for opening said hatch cover when said safety cage is placed in said safety enhancing position.

5. The safety cage of claim 4 wherein said horizontal axes are above said intermediate guard rails.

6. The safety cage of claim 4 wherein said first and second side sections include abutment means preventing said grab bars from swinging laterally outward beyond said normal position.

7. A safety cage having a safety enhancing position relative to a longitudinally extending vehicle mounted tank with a top hatch cover pivotable about a longitudinal axis to one lateral side of the tank, said safety cage comprising:

an upright front section, an upright rear section, a first upright lateral side section connected at its front end to said front section and having a rear end which terminates short of said rear section to provide an access opening, and a second upright lateral side section having opposite ends connected, respectfully, to said front and rear sections, each of said sections having a horizontal top guard rail, a horizontal intermediate guard rail and vertically extending struts interconnecting said top and intermediate guard rails, said top and intermediate guard rails and said interconnecting struts forming a railed enclosure except for said access opening;

a first grab bar section including a first horizontally extending grab bar at its lower end, said first grab bar section being pivotally connected at its upper end to said first lateral section for swinging movement about a first horizontal axis extending in a front to rear direction from a downwardly extending position in which said first grab bar is disposed below said associated intermediate rail to a laterally inward and upward position in which said hatch cover can be fully opened when said safety cage is in said safety enhancing position, and a second grab bar section including a second horizontally extending grab bar at its lower end, said second grab bar section being pivotally connected to said second lateral section for swinging movement about a second horizontal axis from a downwardly extending position in which said second grab bar is disposed below said intermediate rail of said second lateral section to a laterally inward and upward position in which said hatch cover can be fully opened when said safety cage is in said safety enhancing position, said first and second grab bars being at laterally opposite sides of said hatch when said safety cage is in said safety enhancing position.

* * * * *